US005521804A

United States Patent [19]

Degelmann et al.

[11] Patent Number: 5,521,804

[45] Date of Patent: May 28, 1996

[54] LIGHTING FIXTURE HAVING PIVOTABLE LAMP SOCKETS

[75] Inventors: Paul G. Degelmann, Americus, Ga.; Alice M. Jandrisits, Schaumburg, Ill.

[73] Assignee: Cooper Industries, Inc., Houston, Tex.

[21] Appl. No.: 429,098

[22] Filed: Apr. 26, 1995

[51] Int. Cl.[6] ..... F21S 3/00

[52] U.S. Cl. ..... 362/220; 362/217

[58] Field of Search ..... 362/217, 220, 362/225

[56] References Cited

U.S. PATENT DOCUMENTS 2,958,763 11/1960 Bodian .
3,770,952 11/1973 Trowbridge .
4,422,132 12/1983 Trowbridge .
4,992,915 2/1991 Meister .
5,008,790 4/1991 Fabrri .

*Primary Examiner*—Carroll B. Dority
*Attorney, Agent, or Firm*—Burns, Doane, Swecker & Mathis

[57] ABSTRACT

A lighting fixture includes a channel member defining a cavity, and a pair of lamp socket-carrying brackets mounted to the channel member for rotation between a stored position in which the lamp socket is disposed within the cavity, and an operative position wherein the lamp socket projects from the cavity. The channel member includes a pair of side walls, and each bracket includes a pair of side walls situated opposite respective ones of the channel side walls. Each channel side wall includes a semi-circular leg; and each bracket side wall includes a semi-circular pocket spaced from a peripheral edge of the bracket side wall. Each leg includes a nipple engaging a recess of the bracket side wall to define a pivot axis enabling the semi-circular pocket to rotate relative to the semi-circular leg between the stored and operative positions.

8 Claims, 3 Drawing Sheets

FIG. 1
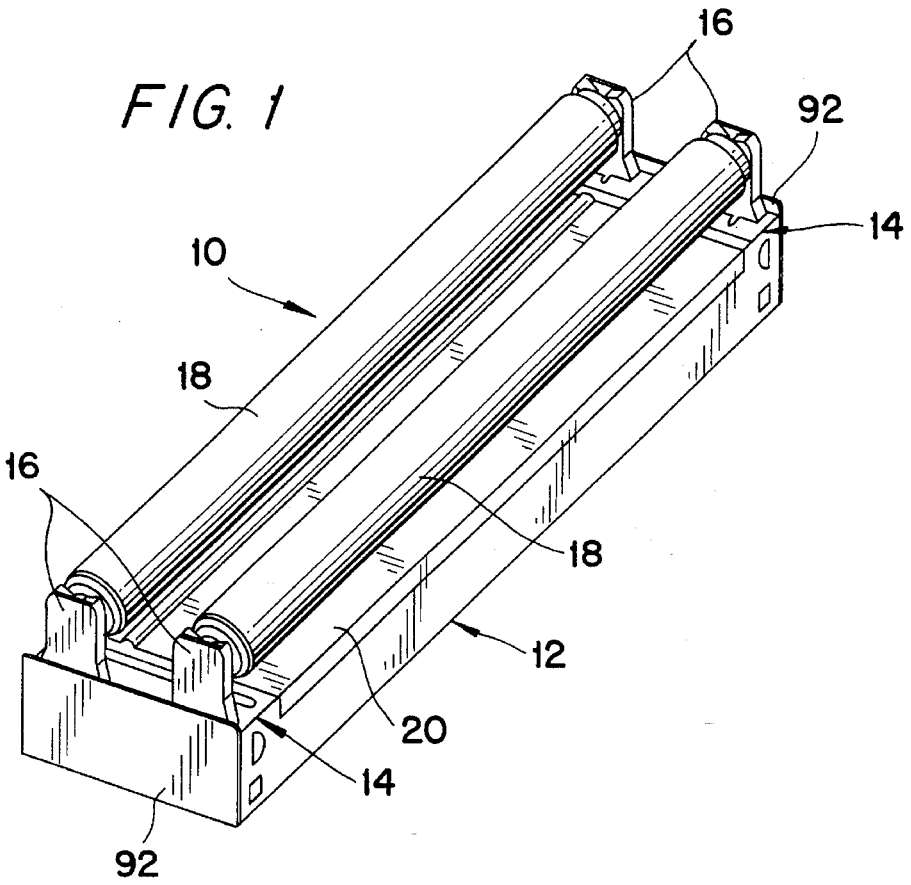
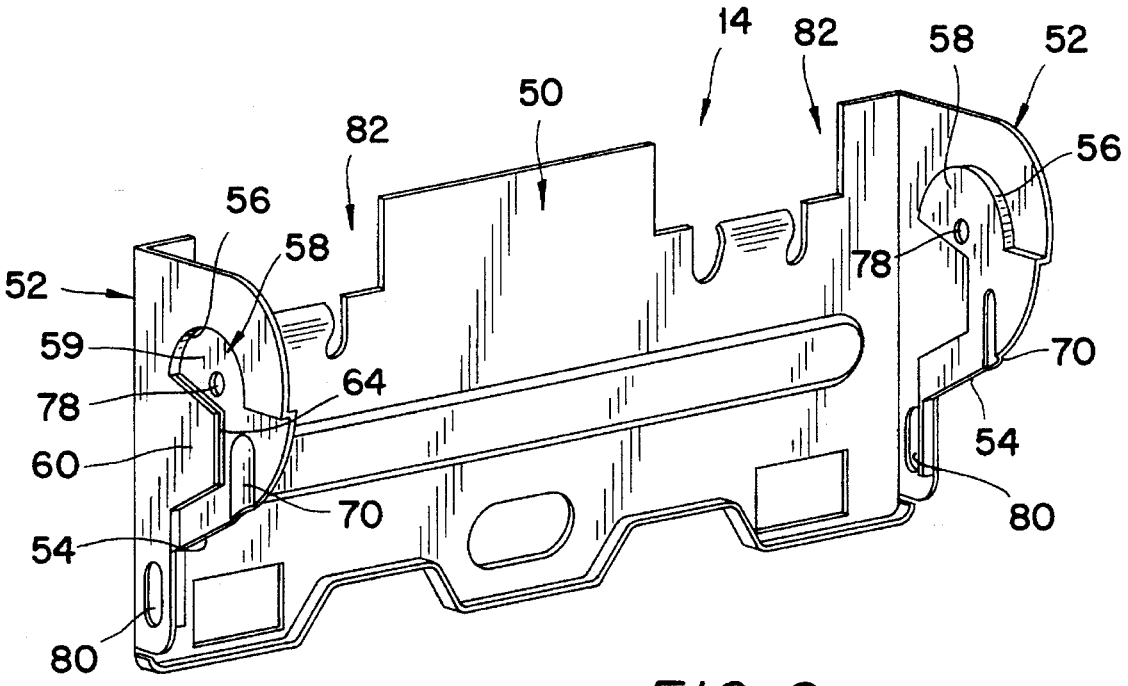
FIG. 2

LIGHTING FIXTURE HAVING PIVOTABLE LAMP SOCKETS

BACKGROUND OF THE INVENTION

The present invention relates to a lighting fixture of the type in which two lamp sockets are mounted at respective ends of a channel member for swinging movement between a stored position and an operative position.

Lighting fixtures of the so-called strip type comprise a channel member having parallel vertical side walls forming a cavity therebetween. Mounted at opposite ends of the cavity are brackets which carry lamp sockets. The sockets are adapted to receive the ends of a lamp, such as a fluorescent lamp.

In order to protect the sockets against damage during shipment, as well as to make the shipping package more compact, it is conventional to mount the socket-carrying brackets for swiveling movement between stored and operative positions, as disclosed for example, in U.S. Pat. Nos. 3,770,952; 4,422,132; 4,992,915; and 5,008,790. In the stored position, the sockets are disposed within the cavity of the channel member. In the operative position, the sockets project out of the cavity.

In order to simplify the installation of the brackets within the channel member, it is conventional to provide the side walls of the channel member with slots that open to an edge thereof, and to provide the side walls of each bracket with ears arranged to enter the slots when the brackets are in a stored orientation (see U.S. Pat. No. 4,442,132). Once installed, the ears define pivot axes enabling the brackets to be swung to the operative position wherein surfaces formed by the ears and slots create an interference connection which prevents removal of the brackets. Hence, the fixture can be packaged and shipped with the brackets in the compact, stored position. The end user can open the package and swing the brackets to the operative position to configure the fixture for installation in a building.

In another conventional arrangement, the location of the slots and ears is reversed, i.e., the slots are placed in the bracket side walls and the ears placed on the side walls of the channel member, with each slot having an enlarged portion comprised of two quarter circles spaced apart by ninety degrees. Each slot extends to an edge of the side wall.

One shortcoming associated with the types of fixtures having a slot extending to an edge of the channel side wall or the bracket side wall is that the side wall becomes weakened and subject to deformation during handling. Presumably it is for that reason, that the fixture disclosed in U.S. Pat. No. 5,008,790 includes a support section for reinforcing the mouth of each slot. However, the need to configure the socket brackets with such support sections adds to the cost and complexity of manufacture.

Also, the need to provide the side walls of the socket brackets or channel member with slots having enlarged portions in the form of quarter circles spaced by ninety degrees results in the removal of substantial portions of the side walls, thereby further weakening the side walls.

It would be desirable to provide a light fixture having swingable socket brackets, wherein the side walls of neither the socket bracket nor channel member are weakened by the presence of slots extending to the edges thereof, or by the presence of a slot enlargement in the form of quarter circles spaced apart by ninety degrees.

SUMMARY OF THE INVENTION

The present invention relates to a lighting fixture comprising a channel member which includes a base plate and a pair of parallel side walls extending parallel to one another from opposing longitudinal edges of the base plate to define a cavity therebetween. Each side wall includes an inner surface facing the inner surface of the other side wall, and a partial cutout bent to form a leg joined to the inner surface by a connecting flange. The leg is oriented parallel to, and spaced inwardly from, the inner surface and includes a generally semi-circular convex outer edge. Two brackets are mounted to respective ends of the channel member. Each bracket carries at least one lamp socket and comprises a front wall and a pair of side walls extending parallel to one another from respective ends of the front wall. Each bracket side wall includes a peripheral edge, and an outwardly facing outer surface which faces the inner surface of a respective one of the side walls. Each bracket side wall further includes a generally semi-circular concave abutment wall upstanding from the outer surface and forming a pocket which faces the peripheral edge at a distance therefrom. A portion of the bracket side wall is offset outwardly from the outer surface to define a retaining wall oriented parallel to a plane of the outer surface. The retaining wall is situated between the pocket and the peripheral edge. Each leg is disposed in the pocket of a respective bracket side wall such that a portion of the leg is disposed between the retaining wall and a plane of the outer surface. The leg and bracket side wall are interconnected by a nipple/recess coupling which defines an axis of rotation for the bracket. That axis is disposed at a common center of both the convex outer edge and the abutment wall. By virtue of that axis, the bracket can be rotated relative to the channel member between a storage position and an operative position. In the storage position, the lamp socket is disposed within the cavity; in the operative position, the lamp socket projects out of the cavity.

Preferably, a portion of each bracket side wall is deformed outwardly toward a respective channel side wall to form a protuberance at a location between the pocket and peripheral edge. The retaining wall and protuberance respectively form first and second guide edges disposed opposite one another to form a gap therebetween. The gap extends in a direction from the peripheral edge to the pocket. A portion of the connecting flange projects into the gap in the storage position of the bracket, and the connecting flange is disposed entirely within the pocket in the operative position of the bracket.

BRIEF DESCRIPTION OF THE DRAWINGS

The objects and advantages of the invention will become apparent from the following detailed description of a preferred embodiment thereof in connection with the accompany drawings in which like numerals designate like elements and in which:

FIG. 1 is a perspective view of a light fixture according to the present invention, with the lamp sockets in an operative position;

FIG. 2 is a perspective view of a lamp socket-carrying bracket according to the present invention;

DETAILED DESCRIPTION OF A PREFERRED EMBODIMENT OF THE INVENTION

Figure 3:
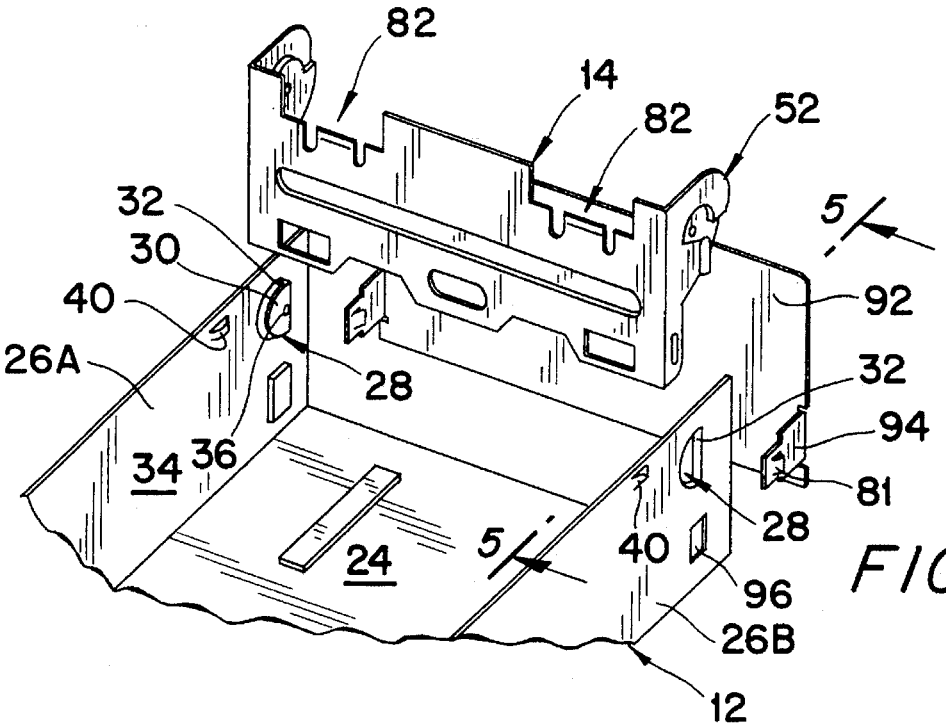
FIG. 3 is a fragmentary exploded view of one end of the lighting fixture as a bracket and end plate are being inserted into a channel member.
Figure 4:
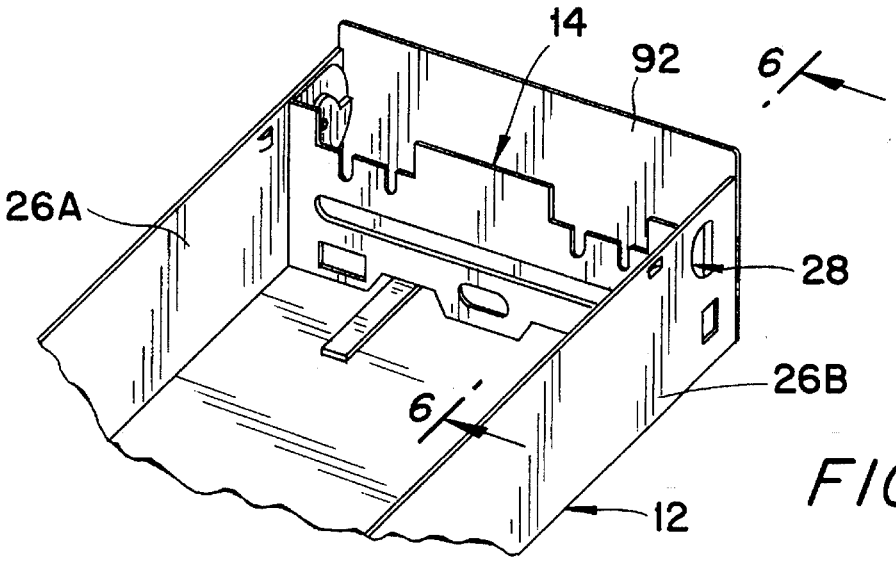
FIG. 4 is a view similar to FIG. 3 after the bracket and end plate have been assembled to the channel member.

Depicted in the figures is a perspective view of a lighting fixture 10 comprised of a channel member 12, a pair of socket brackets 14 disposed at respective ends of the channel member, pairs of socket elements 16 mounted in the socket brackets 14, fluorescent lamps 18 mounted in the sockets 16, and a cover 20 mounted on the channel member.

The channel member 12 comprises a base wall 24, the sides of which are bent at right angles to form mutually parallel side walls 26A, 26B (see FIG. 3). The side walls 26A, 26B are of identical configuration, each including a partially cut-out piece 28 that forms a leg 30 and a connecting flange 32. The leg 30 is oriented parallel to and offset inwardly from an inner surface 34 of the respective side wall 26A or B. An inwardly projecting nipple 36 is formed, e.g., by punching, in each leg 30. That is, the nipple projects toward the interior of a cavity formed between the side walls 26A, 26B. The leg 30 includes a generally semi-circular outer edge 31 (see FIG. 5). Also formed in each side wall 26A, 26B is an inward locking projection 40 formed by making two vertically spaced horizontal slits in the side wall and pushing-in the metal disposed between the slits.

Figure 5:
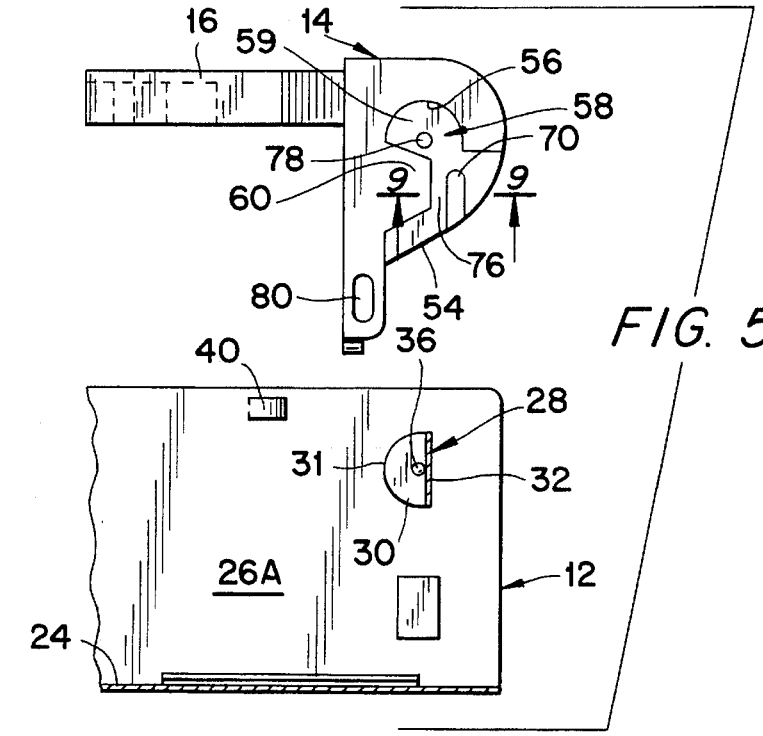
FIG. 5 is a sectional view taken along a plane 5—5 shown in FIG. 3 oriented between a side wall 26B of the channel member, and an end wall 52 of a bracket, the bracket being in the process of assemblage into the channel member and carrying a lamp socket.

The socket brackets 14 are identical, each including a front wall 50, the ends of which are bent at ninety degrees to form two identical, parallel side walls 52 (see FIGS. 2 and 5).

Each side wall 52 includes a curved peripheral edge 54. A portion of the side wall is deformed to define a generally semi-circular abutment wall 56, which extends upwardly from a surface 59. That surface, together with a concave portion of which forms a semi-circular pocket 58 facing the peripheral edge 54.

Figure 9:
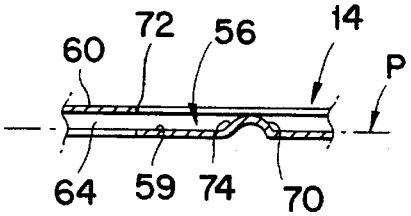
FIG. 9 is a sectional view taken along the line 9—9 in FIG. 5.
Figure 8:
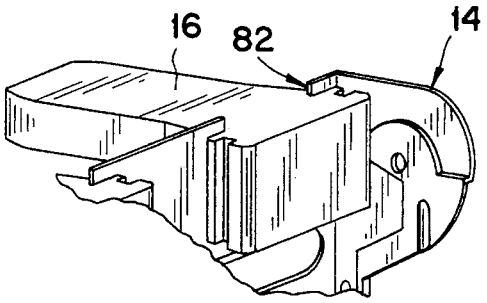
FIG. 8 is a fragmentary perspective view of a bracket depicting a lamp socket mounted therein.

Another portion of the side wall 52 is partially cut away and displaced outwardly from an outer surface 59 of the side wall 52 to form a retaining wall 60 disposed between the pocket 58 and the edge 54 (see FIG. 9). Accordingly, a thin space 64 is formed between the retaining wall 60 and the plane P of the outer surface 59.

Another portion of the side wall 52 is bent to form an outward protuberance 70. That protuberance 70 extends from the edge 54 for part of the distance from the edge to the pocket 58. The retaining wall 60 and protuberance 70 form parallel guide edges 72, 74, respectively, that define therebetween a passage 76 directed toward the pocket 58.

Formed in the outer surface 59 is a circular recess in the form of a hole 78 sized to receive the nipple 36 formed on a respective leg 30.

An elliptical slot 80 is formed in the side wall 52 and is dimensioned to receive the locking projection 40 formed in the respective side wall 26A or 26B as will be explained.

Figure 7:
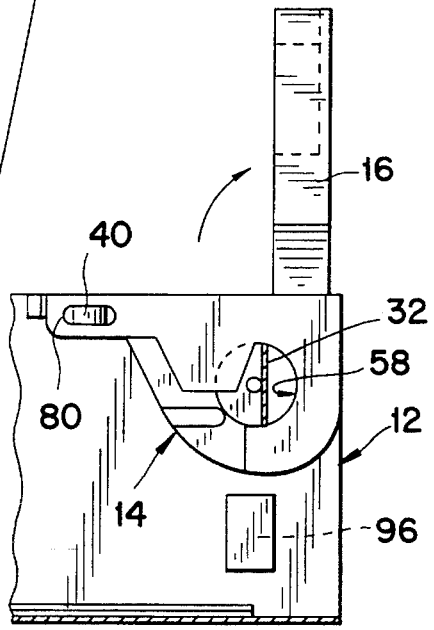
FIG. 7 is a view similar to FIG. 6 after the bracket has been rotated 90 degrees to position the lamp socket in an operative position.

The front wall 50 of the bracket 14 includes pairs of slots 82 adapted to receive the sockets 16 so that the sockets are perpendicular to the front wall (see FIG. 7).

In practice, both socket brackets 14 are installed in the same way into the channel member 12. That is, with reference to FIG. 5, (which constitutes a sectional view taken in FIG. 3 along a plane 5—5 lying between the side wall 26B and an adjacent side wall 52 of a bracket 14), the bracket 14 is oriented so that each passage 76 is generally aligned with the connecting flange 32 of a respective cut-out 28. With the bracket thus oriented, the socket 16 will extend parallel to the base wall 24 of the channel member.

Figure 6:
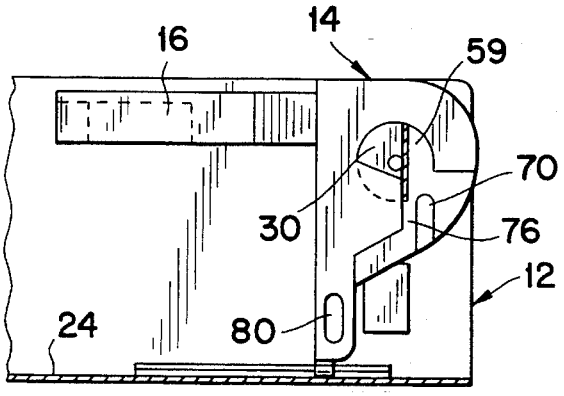
FIG. 6 is a sectional view taken along a plane 6—6 in FIG. 4 after the bracket has been initially assembled and defines a storage position for the lamp socket.

Then, the bracket is inserted downwardly into the cavity so that each of the connecting flanges 32 travels through a passage 76. In so doing, the leg 30 will enter the pocket 58, and the nipple 36 will enter the hole 78 (see FIG. 6). The semi-circular edge 31 of the leg, which edge 31 has the same radius as the abutment wall 56, faces the latter. The nipple 36 and hole 78 lie at a common center of the edge 31 and wall 56 to define an axis of rotation for the bracket. A portion of the connecting flange 32 remains in the passage 76. It will be appreciated that the bracket 14 is in its storage position and cannot become horizontally dislodged (i.e., to the right or left in FIG. 6) from the channel member 12, due to the presence of the connecting flange 32 in the passage 76, and the presence of the nipple 36 in the hole 78 also resists horizontal displacement of the bracket 14.

The fixture is thus in a compact state and can be packaged and shipped with little risk of the sockets 16 being damaged.

The end user who receives the package removes the fixture from the package and rotates the brackets 14 to their operative positions (i.e., the bracket 14 is rotated clockwise to the FIG. 7 operative position). As a result of that rotation, the connecting flange 32 becomes entirely located within the pocket 58, whereby the bracket 14 cannot be dislodged horizontally or vertically from the channel member 12. That is, vertical dislodgement of the bracket is prevented by engagement between the upper and lower ends of the connecting flange 32 with the abutment wall 56; horizontal dislodgement of the bracket to the right in FIG. 7 is prevented by engagement between the connecting flange 32 and the abutment wall 56; horizontal dislodgement of the bracket to the left in FIG. 7 is prevented by contact between the connecting leg 30 and the protuberance. Dislodgement in vertical and horizontal directions is also resisted by the presence of the nipple 36 within the hole 78.

Furthermore, during rotation of the bracket to the operative position, the locking projections 40 of the channel side walls snap into the slots 80 of the bracket side walls so that rotation of the bracket out of the operative position is resisted.

Assemblage of the fixture is completed by the insertion of end plates 92 (see FIG. 3) by inserting fastener tabs 94 thereof into recesses 96 formed in the channel side walls. The fastener tabs include resilient locking protuberances 81 which lock the tabs in place. Also, the channel cover 20 (FIG. 1) is installed, and fluorescent lamps 18 are mounted in the sockets.

The assembled fixture 10 can then be installed, e.g., in a ceiling.

It will be appreciated that the present invention eliminates the presence of a slot in the bracket side wall which extends to the peripheral edge of that side wall and which would undesirably weaken the side wall and facilitate deformation thereof. Also, the need for such a slot having an enlarged portion in the form of a pair of quarter-circles spaced by ninety degrees is avoided to minimize the amount of the bracket side wall which must be cut away to form the slot. Additionally, each pivot connection between a bracket and the channel member requires only a single leg.

Also, the establishment of a pivot connection between the bracket and channel member is promoted by the provision of the nipple/recess coupling between the leg and bracket end wall, which coupling aids in resisting dislodgement of the bracket.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A lighting fixture, comprising:

a channel member including a base plate and a pair of parallel side walls extending parallel to one another from opposing longitudinal edges of the base plate and defining a cavity therebetween, each side wall including an inner surface facing the inner surface of the other side wall, and a partial cutout bent to form a leg joined to the inner surface by a connecting flange, the leg being oriented parallel to, and spaced inwardly from, the inner surface and including a generally semi-circular convex outer edge;

two brackets mounted to respective ends of the channel member, each bracket carrying at least one lamp socket and comprising a front wall, and a pair of side walls extending parallel to one another from respective ends of the front wall, each bracket side wall including:

a peripheral edge, an outwardly facing outer surface facing the inner surface of a respective one of the channel side walls, a generally semi-circular concave abutment wall upstanding from the outer surface and forming a pocket facing the peripheral edge at a distance therefrom, a portion of the bracket side wall being offset outwardly from the outer surface to define a retaining wall oriented parallel to a plane of the outer surface, the retaining wall situated in one direction between the pocket and the peripheral edge;

each leg disposed in the pocket of a respective bracket side wall such that a portion of the leg is disposed between the retaining wall and a plane of the outer surface, the leg and bracket side wall being interconnected by a nipple/recess coupling defining an axis of rotation for the bracket, the axis disposed at a common center of both the convex outer edge and the abutment wall and enabling the bracket to be rotated relative to the channel member between:

a storage position wherein the at least one lamp socket is disposed within the cavity, and an operative position wherein the at least one lamp socket projects out of the cavity.

2. The lighting fixture according to claim 1, wherein a portion of each bracket side wall is deformed outwardly toward a respective channel side wall to form a protuberance at a location between the pocket and peripheral edge; the retaining wall and protuberance respectively forming first and second guide edges disposed opposite one another to form a gap therebetween, the gap extending in a direction from the peripheral edge to the pocket, a portion of the connecting flange projecting into the gap in the storage position of the bracket, the connecting flange disposed entirely within the pocket in the operative position of the bracket.

3. The lighting fixture according to claim 2, wherein at least one of the first and second guide edges extends to the peripheral edge.

4. The lighting fixture according to claim 1, wherein each channel side wall forms a locking connection with a respective bracket side wall when the brackets are in their operative positions.

5. The lighting fixture according to claim 4, wherein the locking connection comprises an inwardly bent portion of each channel side wall and a recess formed in each bracket side wall.

6. The lighting fixture according to claim 1, wherein the nipple/recess coupling comprises an inwardly projecting nipple on the leg and a recess formed in the bracket side wall.

7. The lighting fixture according to claim 3, wherein each channel side wall forms a locking connection with a respective bracket side wall when the brackets are in their operative positions; the nipple/recess coupling comprising an inwardly projecting nipple on the leg and a recess formed in the bracket side wall.

8. The lighting fixture according to claim 1, wherein each channel side wall forms a locking connection with a respective bracket side wall when the brackets are in their operative positions; the nipple/recess coupling comprising an inwardly projecting nipple on the leg and a recess formed in the bracket side wall.

* * * * *